United States Patent [19]

Kishida et al.

[11] Patent Number: 4,641,816

[45] Date of Patent: Feb. 10, 1987

[54] APPARATUS FOR STRETCHING, LOOSENING, AND FIXING A WIRE MEMBER

[75] Inventors: Hiroo Kishida; Hirofumi Takenaka, both of Osaka, Japan

[73] Assignee: Harumoto Iron Works Co., Ltd., Osaka, Japan

[21] Appl. No.: 743,962

[22] Filed: Jun. 12, 1985

[30] Foreign Application Priority Data

Oct. 6, 1984 [JP] Japan ..... 59-210152

[51] Int. Cl.[4] ..... B21F 9/02; F16G 11/04

[52] U.S. Cl. ..... 254/228; 24/115 M; 24/136 R; 254/257

[58] Field of Search ..... 254/228, 254, 250, 251, 254/252, 253, 256, 257, 258, 264; 52/223 L; 24/115 R, 115 M, 122.6, 136 R

[56] References Cited

U.S. PATENT DOCUMENTS

| | | | |
|---|---|---|---|
| 2,945,563 | 7/1960 | O'Hara | 24/136 R X |
| 3,412,511 | 11/1968 | Dietrich | 52/223 L X |
| 3,701,509 | 10/1972 | Stinton | 52/223 L X |
| 3,776,586 | 12/1973 | Ahlgren et al. | 24/136 R X |
| 3,795,949 | 3/1974 | Shorter | 24/115 M |
| 3,863,302 | 2/1975 | Welbergen et al. | 24/115 M X |
| 3,965,542 | 6/1976 | Gregory | 24/136 R |
| 4,114,242 | 9/1978 | Luthi | 24/115 R |
| 4,454,633 | 6/1984 | de la Fuente et al. | 254/228 X |

*Primary Examiner*—Stuart S. Levy
*Assistant Examiner*—Joseph J. Hail, III
*Attorney, Agent, or Firm*—Wenderoth, Lind & Ponack

[57] ABSTRACT

An apparatus for stretching, loosening, and fixing a wire member includes a grasping member for grasping an end of the wire member, a displacing member for displacing the grasping member so as to stretch/loosen the wire member in the longitudinal direction thereof, a fixing member having a wedge receiving face, and a wedge member disposed axially between the fixing member and the grasping member. The wedge has a wedge face tapering toward the wedge receiving face of the fixing member and is divided circumferentially into a plurality of parts. A pushing member pushes the wedge member toward the wedge receiving face of the fixing member, and a holding member holds the wedge member away from the fixing member when the wire member is stretched/loosened by the displacing member.

3 Claims, 13 Drawing Figures

Fig. 3 (1)
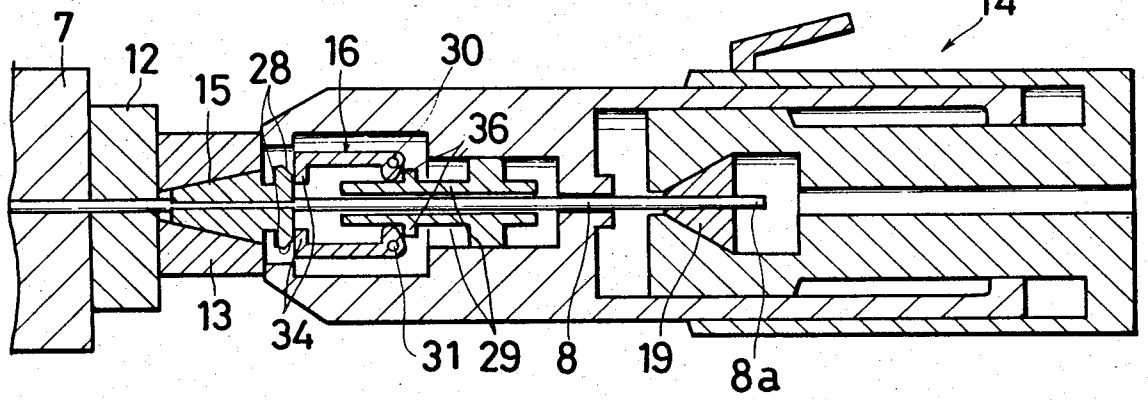
Fig. 3 (2)
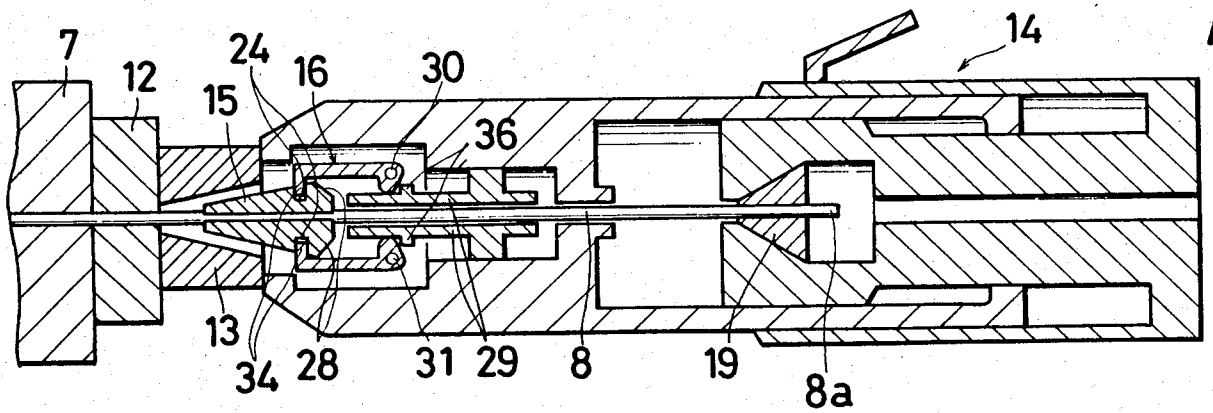

APPARATUS FOR STRETCHING, LOOSENING, AND FIXING A WIRE MEMBER

BACKGROUND OF THE INVENTION

1. Field of the Invention

The present invention relates to an apparatus for stretching, loosening and fixing a wire member such as PC (prestressed concrete) steel wires or the like so that specified compression stress is applied to a structure made of concrete.

2. Description of the Prior Art

There is conventionally known a wedge fixation method for stretching and loosening PC steel wires. According to this method, with the use of a jack capable of simultaneously stretching a PC steel wire and pushing a wedge, a PC steel wire is stretched and a steel wedge is then pushed into a wedge housing space in a fixing member to fix the PC steel wire therein. In order to finely adjust the tension of the PC steel wire after completion of such fixation, it is required to slightly pull out the wedge thus pushed into the wedge housing space, from the wedge housing space for relieving the PC steel wire of the tension. However, at the time the PC steel wire is loosened, the wedge is pushed into the fixing member due to frictional force, thereby preventing the PC steel wire from being loosened and fixed. Special fixing means are therefore required in addition to the jack. Accordingly the number of required devices is therefore increased, thus disadvantageously decreasing working efficiency and safety.

SUMMARY OF THE INVENTION

To solve the aforementioned problems, it is an object of the invention to provide an improved and novel apparatus for stretching, loosening, and fixing wire members.

It is another object of the invention to provide an apparatus having a simple construction capable of stretching, loosening and fixing wire members such as PC steel wires.

To accomplish the above objects, an apparatus for stretching, loosening, and fixing a wire member in accordance with the invention comprises means for grasping an end of a wire member, means for displacing the grasping means so as to stretch/loosen the wire member in the longitudinal direction thereof, a fixing member having a wedge receiving face, a wedge member disposed axially between the fixing member and the grasping member, the wedge member having a wedge face tapering toward the wedge receiving face of the fixing member and divided circumferentially thereof into a plurality of parts, means for pushing the wedge member toward the wedge receiving face of the fixing member, and means for holding the wedge member away from the fixing member when the wire member is stretched/-loosened by means of the displacing means.

In a preferred embodiment, the holding means comprises a holding member adapted to hold the wedge member when the wire member is stretched/loosened and to be dissociated from the wedge member when the wedge member is pushed toward the wedge receiving faces.

In another preferred embodiment, the wedge member has a recess formed on the outer periphery thereof and the holding member is adapted to be associated with the recess.

In still another preferred embodiment, the wedge member has a recess formed on the inner periphery thereof and the holding member is adapted to be associated with such recess.

In yet another preferred embodiment, the recess formed on the inner periphery of the wedge member comprises means for engaging with the holding member.

Preferably, the pushing means comprises a pushing bar, and at least one of the wedge member and the pushing bar comprises magnetic means and at least one of the wedge member and pushing bar is adapted to be magnetically attracted to such magnetic means.

Still preferably, the wire member is a PC steel wire.

Consequently, according to the present invention, the tension in a wire member is adjusted by a wedge which is held, thereby preventing the wedge from being displaced due to friction between the wedge and the wire member. This assures stretching, loosening and fixation of the wire member. Such stretching, loosening and fixation require no special jigs which have been conventionally used, thereby simplifing the working process and improving efficiency.

BRIEF DESCRIPTION OF THE DRAWINGS

These and other objects, features and advantages of the invention will become more apparent from the following detailed description with reference to the accompanying drawings, in which.

DETAILED DESCRIPTION OF THE PREFERRED EMBODIMENTS

Figure 1:
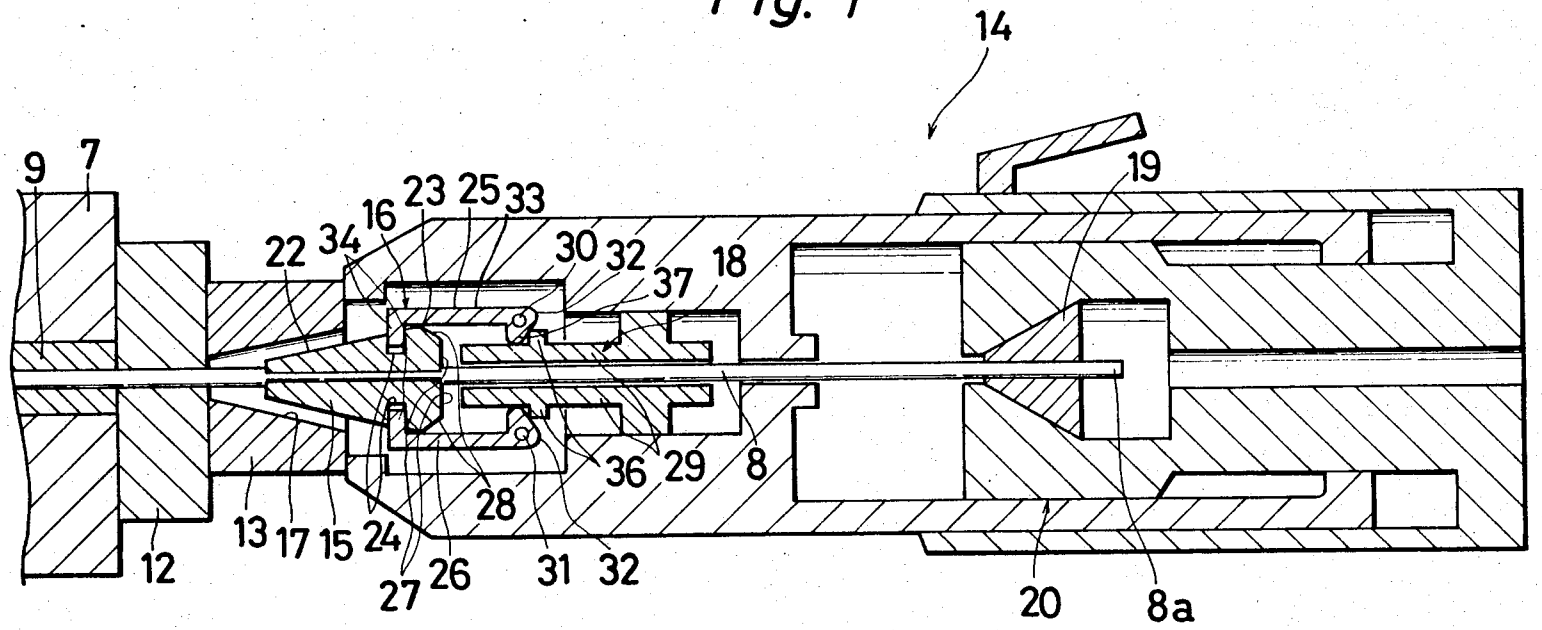
FIG. 1 is a sectional view showing an apparatus for stretching, loosening and fixing PC steel wires in accordance with the present invention.

Referring now to the drawings, preferred embodiments of the invention are described below.

FIG. 1 is a sectional view of an apparatus 14 in accordance with the invention. The apparatus 14 includes a holding member 16 for holding a wedge 15 adapted to be housed in a fixing member 13 for a concrete floor plate 7 to be discussed below, a pushing member 18 for pushing the wedge 15 toward a wedge receiving face 17 of the fixing member 13, a grasping member 19 for grasping an end 8*a* of a PC steel wire 8 and a member 20 for displacing the grasping means 19 so as to stretch-/loosen the steel wire 8 in the longitudinal direction of the steel wire 8. These members 16, 18, 19, and 20 are arranged in this order in the direction from one end (the left side as viewed in FIG. 1) of the apparatus 14 to the other end thereof (the right side as viewed in FIG. 1).

The PC steel wire 8 is introduced to the outside via the cylindrical fixing member 13 through a support member 12. In the inner periphery of the fixing member 13, there is formed wedge receiving face 17 expanding in the direction (the right side as viewed in FIG. 1) away from the support member 12.

Figure 2:
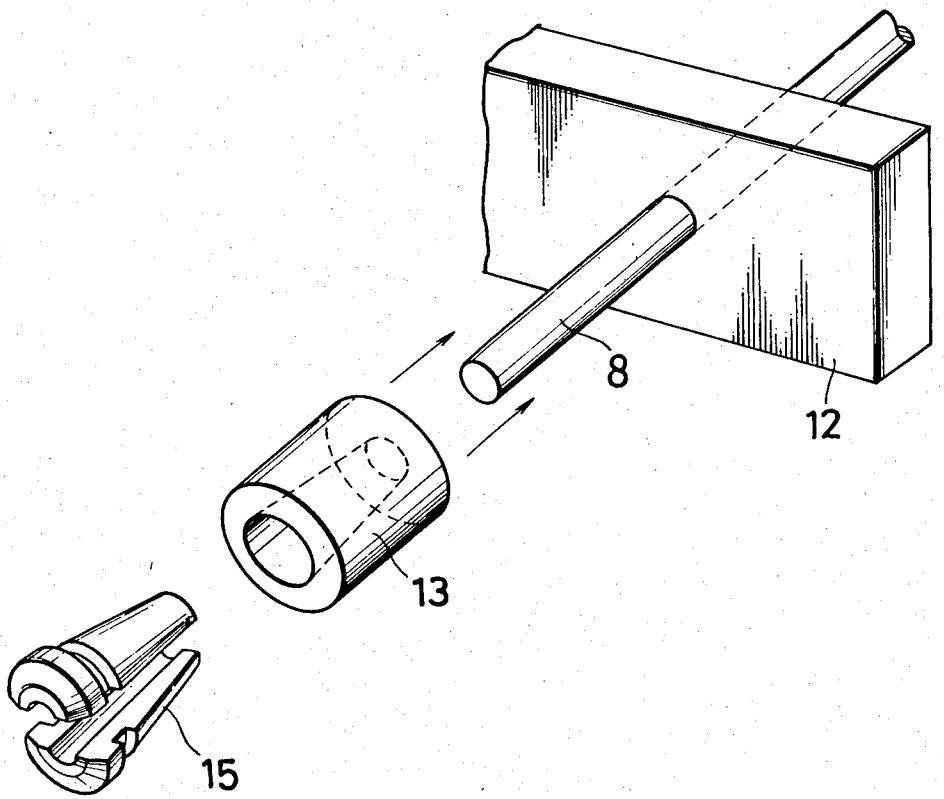
FIG. 2 is an exploded perspective view showing a wedge and its vicinity of the invention.

The wedge 15 has a wedge face 22 tapering toward the wedge receiving face 17 and is removably mounted. As shown in FIG. 2, the wedge 15 is circumferentially divided into two or more parts. The wedge has formed in the wedge face 22 a circumferential recess 24 adjacent to a larger-diameter portion 23 of the wedge 15. The wedge 15 has a sliding face 28 tapering toward a base end face 27 of the wedge 15 between the larger-diameter portion 23 and the base end face 27. Through this sliding face 28, an engagement portion 34 of the holding member 16 may be engaged with and disengaged from the recess 24, as discussed later.

The pushing member 18 may push and move the wedge 15 toward the wedge receiving face 17 of the fixing member 13. The pushing member 18 includes a pair of pushing rods 29 adapted to come into contact with the base end face 27 of the wedge 15 and extending parallel with the PC steel wire 8, and a drive source (not shown) for moving the pushing rods 29 in the axial direction thereof.

A pair of support shafts 30 and 31 secured integrally with the main body of the apparatus, are disposed outside the pushing rods 29. Substantially L-shaped holding portions 25 and 26 are respectively pivoted by the support shafts 30 and 31. The holding portion 25 has a pivot portion 32 pivoted by the support shaft 30, an extending portion 33 integral with the pivot portion 32, and an engagement portion 34 adapted to be fitted into the recess 24 of the wedge 15. A torsion spring (not shown) is disposed at the pivot portion 32. The engagement portion 34 is normally spring-loaded in the direction toward the PC steel wire 8 around the axis of the support shaft 30 by the torsion spring. The pivot portion 32 has a projection 37 to come into contact with a dog 36 formed on each of the pushing rods 29 of the pushing member 18. When the pushing rod 29 moves towards the wedge 15 (toward the left side as viewed in FIG. 1), the dog 36 causes the projection 37 to be angularly displaced around the axis of the support shaft 30. This causes the engagement portion 34 integral with the extending portion 33 to be angularly displaced in the direction away from the PC steel wire 8. The engagement portion 34 is then disengaged from the recess 24 of the wedge 15. The holding portion 26 has the same construction as that of the holding portion 25. The holding portion 25 and 26 are arranged symmetrically with respect to the PC steel wire 8.

Figure 3:
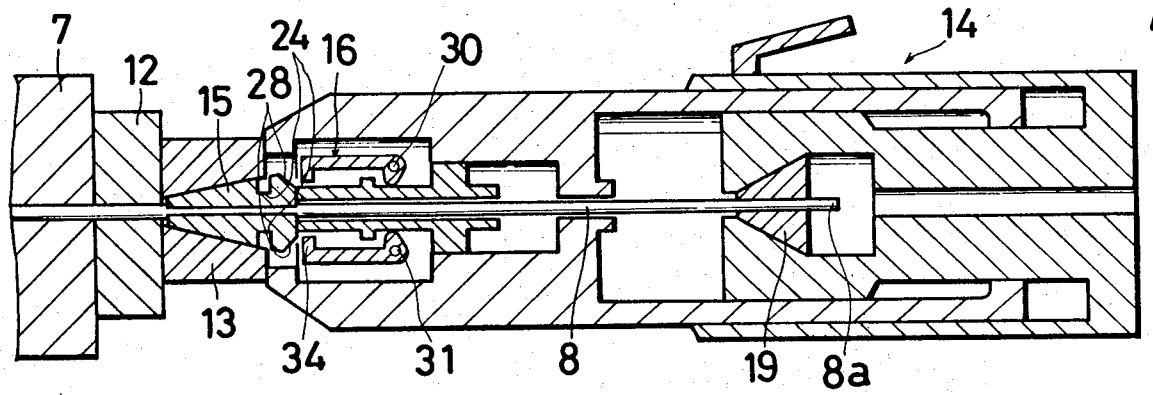
FIGS. 3(1) through 3(5) are sectional views showing the process of stretching, loosening, and fixing the PC steel wires.
Figure 3:
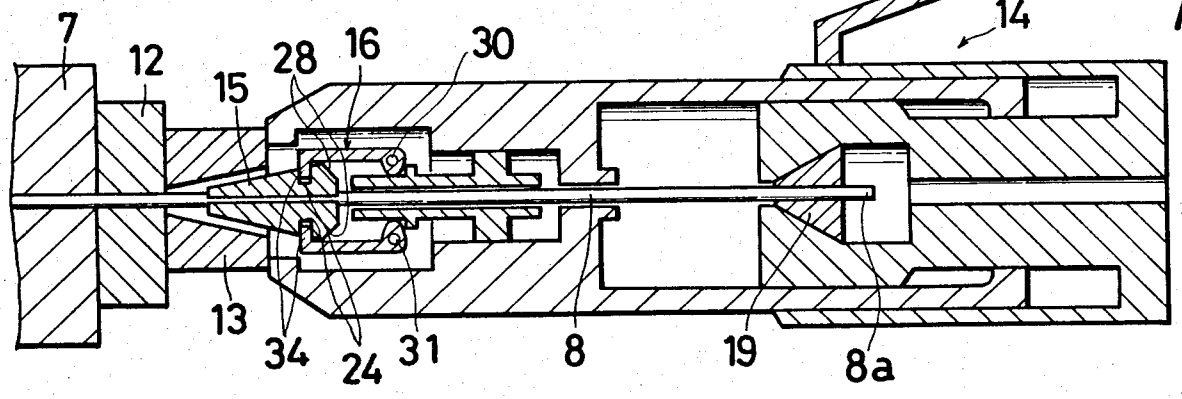
Figure 3:
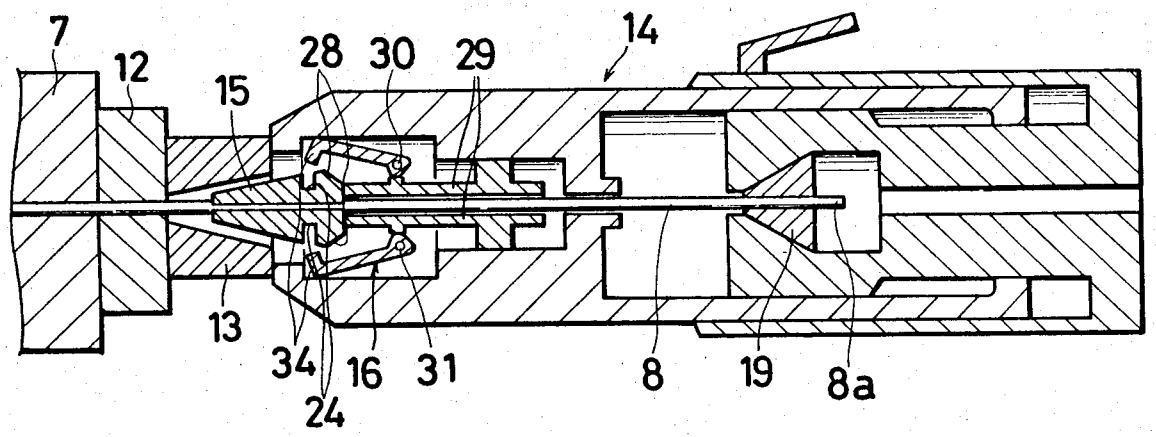

With reference to FIGS. 3(1) through 3(5), description will now be made as to how the present apparatus 14 operates to apply tension to the PC steel wire 8. The present apparatus 14 is disposed at the side of the fixing member 13 as shown in FIG. 3(1). The end **8*a* of the PC steel wire 8 is held by the grasping means 19. At this time, the wedge 15 is housed in the fixing member 13, and the engagement portions 34 of the holding member 16 are disengaged from the recess 24 of the wedge 15. The pushing rods 29 are held retracted at the right side as viewed in FIG. 3(1). With the end 8*a* of the PC steel wire 8 grasped by the grasping means 19, the grasping means 19 is then pulled out by a hydraulic means 20 or the like to stretch the PC steel wire 8, and the engagement portions 34 are fitted into the recess 24, as shown in FIG. 3(2). Upon the completion of application of tension to the PC steel wire 8, the pushing rods 29 are forwardly moved to the left side as viewed in FIG. 3(2). The pushing rods 29 are further advanced to the left side as viewed in FIG. 3(2) such that the wedge 15 is pushed and housed in the fixing member 13 as shown in FIG. 3(3). The PC steel wire 8 is then fixed due to the wedging action imparted by wedge 15. Prestress is thus imparted to steel wire 8 to thereby apply compression stress to the concrete floor plate 7**.

In order to adjust the compression stress present in the concrete floor plate 7, it is required to stretch, loosen and fix the PC steel wire 8. The present apparatus 14 alone may achieve such stretching, loosening and fixation.

The end **8*a* of the PC steel wire 8 thus fixed is pulled out by the grasping means 19, thereby pulling out the wedge 15 from the fixing member 13. The engagement portions 34 of the holding member 16 slide on the sliding face 28 of the wedge 15 to fit in the recess 24 as shown in FIG. 3(4). The holding member 16 prevents the wedge 15 from being displaced. The grasping means 19 is then moved to the left side as viewed in FIG. 3(4) to loosen the PC steel wire 8. At this time, the wedge 15 held by the holding member 16, is not moved into the fixing member 13 with the PC steel wire 8. The PC steel wire 8 is thus adjusted in tension to a predetermined value. Thereafter, the holding member 16 is disengaged from the wedge 15 by the pushing rods 29 as shown in FIG. 3(5). Further advancement of the pushing rods 29 causes the wedge 15 to be fixed and housed in the fixing member 13, so that the PC steel wire 8** is fixed.

A plurality of concrete floor plates 7 are then laid on steel beams 4 and are integrated with cement mortar or the like which is put between the plates 7. Thereafter, the present apparatus 14 operates to relieve the PC steel wires 8 of the tension so as to remove the prestress from the plates 7.

As discussed hereinbefore, the PC steel wire 8 may be stretched, loosened and fixed with the use of a single apparatus, thereby remarkably improving efficiency. Such reduction in the number of required devices improves working efficiency and safety.

Figure 4:
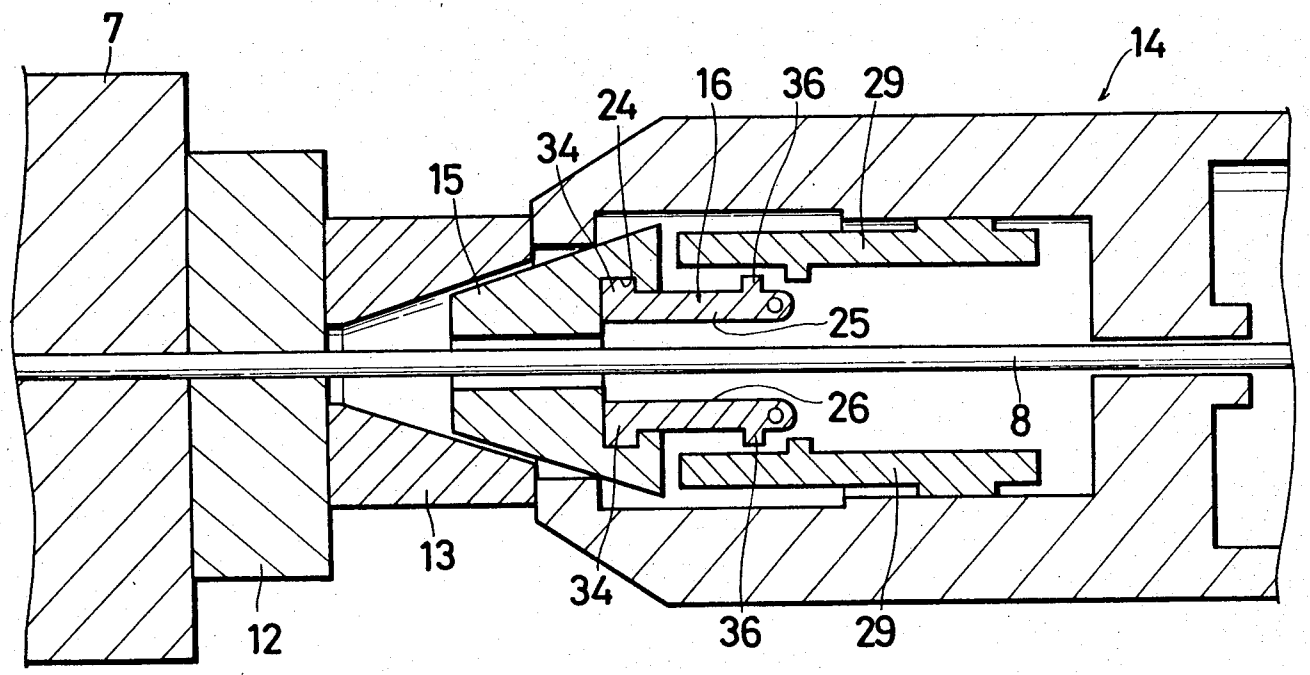
FIG. 4 is a sectional view showing another embodiment in accordance with the invention.

FIG. 4 is a sectional view of a second embodiment of the present invention, which has a construction similar to that shown in FIG. 1. In FIG. 4, like parts are designated by like numerals used in FIG. 1.

In this second embodiment, the holding member 16 is disposed between the pushing rods 29 and the PC steel wire 8. The engagement portions 34 of the holding member 16 are formed to project in directions away from the PC steel wire 8. The wedge 15 is provided at the inner peripheral face thereof with the recess 24 with which the engagement portions 34 are adapted to engage. When the wedge 15 is held by the holding member 16, the wedge 15 is separated from the PC steel wire 8. Friction between the wedge 15 and the PC steel wire 8 is therefore reduced, thereby further facilitating the operation of stretching, loosening and fixing the PC steel wire 8.

Figure 5:
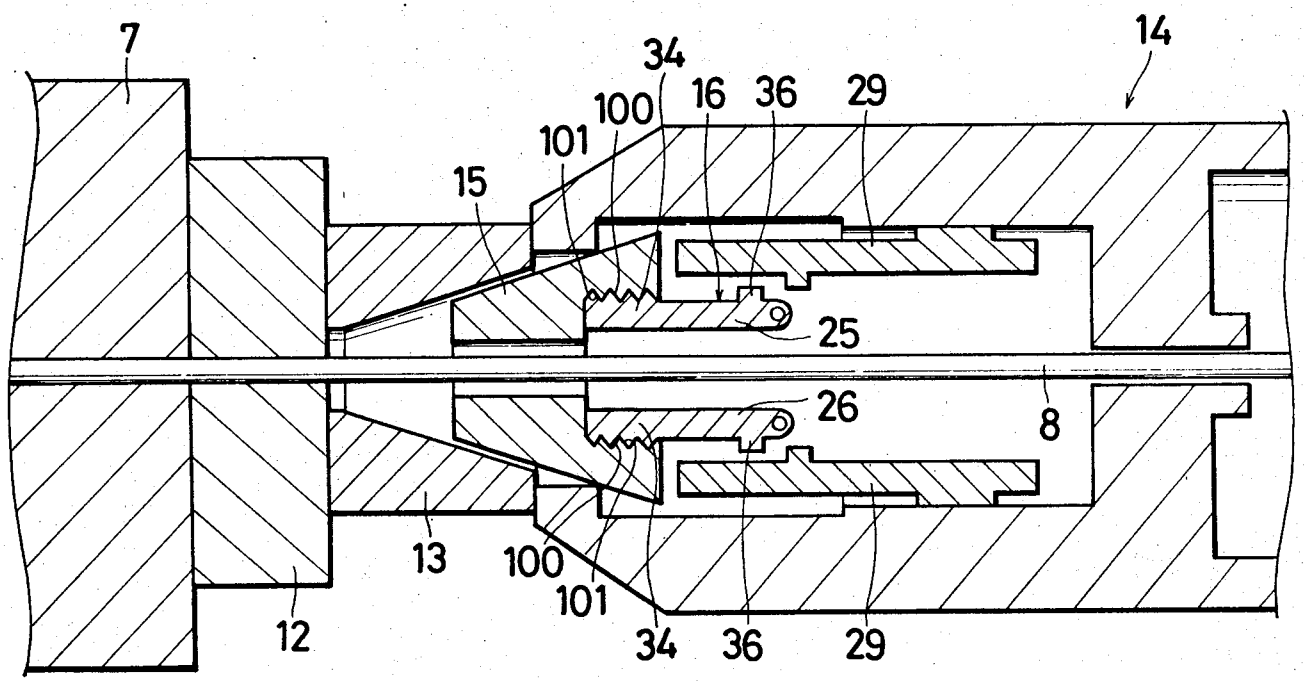
FIG. 5 is a sectional view showing still another embodiment in accordance with the invention.

FIG. 5 illustrates a third embodiment of the present invention, which has a construction similar to that of FIG. 4. In FIG. 5, like parts are designated by like numerals used in FIG. 4.

In this third embodiment, each of the engagement portions 34 of the holding member 16 has a rack 100, and the wedge 15 has at its recess 24 a rack 101 with which the racks 100 are adapted to engage. Engagement of the racks 100 with the rack 101 securely prevents the wedge 15 from being moved by friction between the PC steel wire 8 and the wedge 15 at the time the PC steel wire 8 is stretched, loosened and fixed. As compared with the second embodiment in which the engagement portions 34 of the holding member 16 are fitted in the recess 24 in the wedge 15, engagement of the racks with each other may be made more readily and securely, thereby greatly improving utility.

Figure 6:
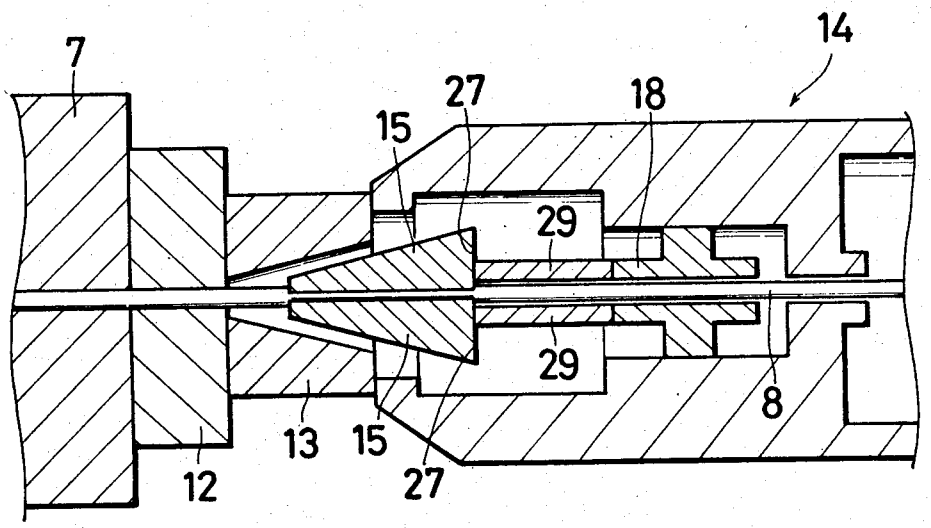
FIG. 6 is a sectional view showing yet another embodiment in accordance with the invention.

FIG. 6 is a sectional view of a forth embodiment of the present invention, which has a construction similar to that shown in FIG. 1. In FIG. 6, like parts are designated by like numerals used in FIG. 1.

In this fourth embodiment, the tips of the pushing rods 29 of the pushing member 18 adapted to come into contact with the base end face 27 of the wedge 15 made of steel are made of magnetic material. The intensity of the magnetic force of the pushing rods 29 is determined such that the wedge 15 pulled from the fixing member 13 is attracted sufficiently so as not to be moved in association with the movement of the PC steel wire 8, and the pushing rods 29 may be separated from the wedge 15 after the wedge 15 is fixed and housed in the fixing member 13 by the pushing rods 29. Such arrangement enables the wedge 15 to be attracted to and held by the pushing rods 29 at the time the PC steel wire 8 is stretched, loosened and fixed. Such arrangement also enables the present apparatus 14 to be simplified in construction.

Figure 7:
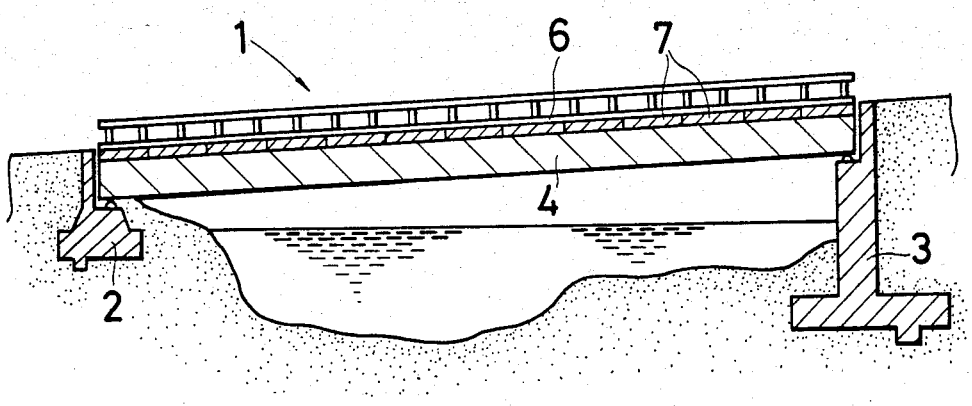
FIG. 7 is a side view showing an embodiment of a bridge practically employing the invention.
Figure 8:
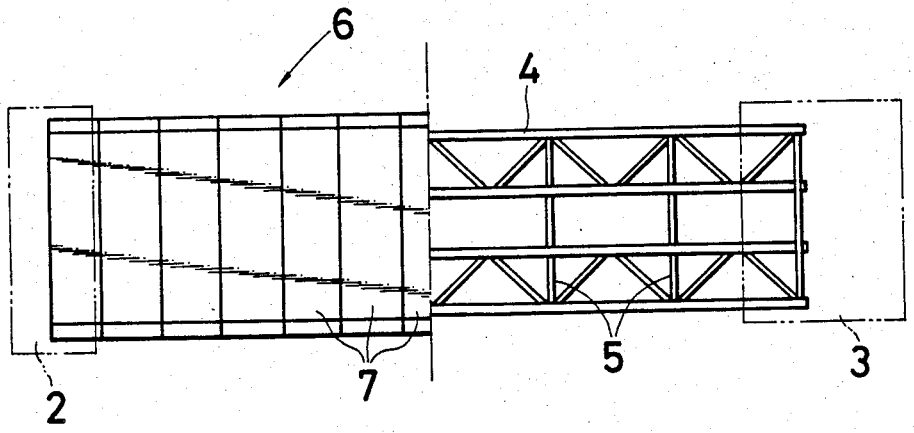
FIG. 8 is a top plan view of FIG. 7.

FIG. 7 is a side view of a bridge for which the apparatus 14 in accordance with the present invention is used. FIG. 8 is a plan view of FIG. 7.

A bridge 1 is supported at its opposite ends by abutments 2 and 3. The bridge 1 has a framework which includes a plurality of main beams 4 each made of steel having an I-shaped section and extending in its axial direction, and cross beams or sway bracings 5 made of steel supported by the main beams 4.

A passage member 6 is disposed on the steel beams 4. In FIG. 8, the passage member 6 is omitted at its right-hand half portion to give a better understanding of the bridge structure. This passage member 6 is formed of a plurality of concrete floor plates 7 joined to each other. These concrete floor plates 7 are so-called precast floor plates previously manufactured at a factory. Embedded in each of the concrete floor plates 7 is a sheath tube 9 in which a PC steel wire 8 is disposed in parallel with the steel beam 4.

Figure 9:
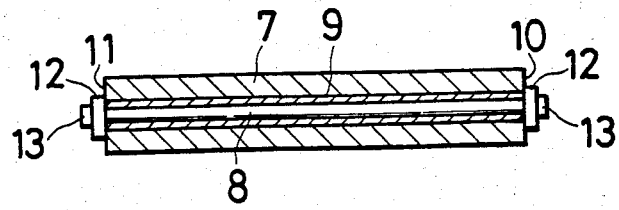
FIG. 9 is a sectional view showing a concrete floor board.

FIG. 9 is a sectional view of the concrete floor plate 7. Inserted in the concrete floor plate 7 is a sheath tube 9 extending from one end 10 of the concrete floor plate 7 to the other end 11 thereof. Inserted in the sheath tube 9 is a PC steel wire 8 for applying compression stress to the concrete floor plate 7. The PC steel wire 8 is fixed by a support plate 12 and a fixing member 13 at each of the ends 10 and 11 of the concrete floor plate 7. Predetermined tension as adjusted may be applied to the PC steel wire 8 by the apparatus 14 for stretching, loosening and fixing a wire member in accordance with the present invention. Compression stress is then produced in the concrete floor plate 7 through the support plates 12. The fixing members 13 are disposed for fixing and fastening the PC steel wire 8.

The apparatus for stretching, loosening and fixing the PC steel wires 8 in accordance with the present invention may be used not only as a jack for stretching a PC steel material, but also as a tension adjusting device to be used after the PC steel material has been stretched and fixed. The apparatus of the present invention therefore has very valuable utility.

In the embodiments discussed hereinbefore, the present apparatus 14 has been used as apparatus for stretching, loosening and fixing PC steel wires in concrete floor plates. The present apparatus 14 is not however limited to such application. For example, the present apparatus may also be used for stretching, loosening and fixing PC steel wires to be used for introduction of prestress into concrete structural members. The present apparatus may also be used for stretching, loosening and fixing cables which supportingly connect the main beams and the support tower of an oblique suspension bridge, or cables which support the bridge floor of a suspension bridge.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. An apparatus for imparting tension to, loosening the tension in and fixing the position of an anchored wire member, said apparatus comprising:

a fixing member having therein a recess defining a conical wedge receiving face and through which an anchored wire member is to extend;

a wedge member having an outer wedge face tapering toward said wedge receiving face, said wedge member being divided circumferentially into a plurality of parts, said wedge member surrounding and gripping the wire member and fitting into said recess with said wedge face abutting said wedge receiving face, thereby fixing the position of the wire member;

a main body to be abutted with said fixing member with the wire member extending into said main body;

means, mounted within said main body, for grasping a free end of the wire member;

means for displacing said grasping means with respect to said main body in a direction away from said fixing member, and thereby for tensioning the wire member grasped by said grasping means and thus for causing the wire member gripped by said wedge member to withdraw said wedge member from said recess in said fixing member;

means for holding said wedge member in the thus withdrawn position thereof, said holding means comprising at least one holding member having first and second portions and pivotally mounted on said main body for pivoting movement about a pivot between a first position, whereat said first portion engages said wedge member to maintain said wedge member in said withdrawn position thereof, and a second position, whereat said first portion is out of engagement with said wedge member; and pushing means, mounted on said main body for movement relative thereto, for abutting said second portion of said holding member to pivot said holding member from said first position thereof to said second position thereof, thus releasing said wedge member, and then for abutting and pushing the thus released said wedge member with respect to the wire member toward said fixing member until said wedge member enters said recess with said wedge face abutting said wedge receiving face and with said wedge member again gripping the wire member, thereby fixing the position of the tensioned wire member.

2. An apparatus as claimed in claim 1, wherein said wedge member has formed in an outer periphery thereof a recess, and said first portion of said holding member comprises a projection extending inwardly into said recess in said first position of said holding member.

3. An apparatus as claimed in claim 1, wherein said wedge member has formed in an inner periphery thereof a recess, and said first portion of said holding member comprises a projection extending outwardly into said recess in said first position of said holding member.

* * * * *